US005732390A

United States Patent [19]

Katayanagi et al.

[11] Patent Number: 5,732,390

[45] Date of Patent: Mar. 24, 1998

[54] SPEECH SIGNAL TRANSMITTING AND RECEIVING APPARATUS WITH NOISE SENSITIVE VOLUME CONTROL

[76] Inventors: Keiichi Katayanagi; Kentaro Odaka; Masayuki Nishiguchi, all of c/o Sony Corporation 7-35, Kitashinagawa 6-chome, Shinagawa-ku, Tokyo, Japan

[21] Appl. No.: 695,522

[22] Filed: Aug. 12, 1996

Related U.S. Application Data

[63] Continuation of Ser. No. 263,125, Jun. 21, 1994, abandoned.

[30] Foreign Application Priority Data

Jun. 29, 1993 [JP] Japan ..... 5-182138
Mar. 11, 1994 [JP] Japan ..... 6-040729

[51] Int. Cl.[6] ..... G10L 9/14

[52] U.S. Cl. ..... 704/227; 704/222; 704/223; 704/225; 704/226; 704/228; 704/233

[58] Field of Search ..... 395/2.34–2.37, 395/2.31, 2.32, 2.42

[56] References Cited

U.S. PATENT DOCUMENTS

| | | | |
|---|---|---|---|
| 4,628,529 | 12/1986 | Borth et al. | 395/2.34 |
| 4,817,157 | 3/1989 | Gerson . | |
| 5,111,454 | 5/1992 | Hung et al. | 370/95.3 |
| 5,146,504 | 9/1992 | Pinckley | 381/46 |
| 5,432,859 | 7/1995 | Yang et al. | 381/94 |

FOREIGN PATENT DOCUMENTS

A-02 502135 7/1990 Japan .

OTHER PUBLICATIONS

Rabiner and Schafer, *Digital Processing of Speech Signals*, Prentice Hall International, 1978, pp. 447–453.

IRA A. Gerson and Mark A. Jasiuk: "Vector Sum Excited Linear Prediction (VSELP) Speech Coding at 8 KBPS," Chicago Corporate Research and Development Center, Motorola Inbc., Schaumburg, IL, Int.Conf.on Acoustics, Speech & Signal Processing, Apr. 1990.

*Primary Examiner*—Allen R. MacDonald
*Assistant Examiner*—Alphonso A. Collins
*Attorney, Agent, or Firm*—Limbach & Limbach L.L.P.

[57] ABSTRACT

A speech signal transmitting receiving apparatus, such as a portable telephone set, includes a speech signal transmitting encoding circuit, a noise domain detection unit, a noise level detection unit and a controller. The speech signal transmitting encoding circuit compresses input speech signals by digital signal processing at a high efficiency. The noise domain detection unit detects the noise domain using an analytic pattern produced by the speech signal transmitting encoding circuit. The noise level detection unit detects the noise level of the noise domain detected by the noise domain detection unit. The controller controls the received sound volume responsive to the noise level detected by the noise level detection unit.

22 Claims, 8 Drawing Sheets

SPEECH SIGNAL TRANSMITTING AND RECEIVING APPARATUS WITH NOISE SENSITIVE VOLUME CONTROL

This is a continuation of application Ser. No. 08/263,125 filed Jun. 21, 1994, now abandoned.

BACKGROUND

1. Field of the Invention

This invention relates to a speech signal transmitting and receiving apparatus. More particularly, it relates to a speech signal transmitting and receiving apparatus for high efficiency compression of speech signals by digital signal processing.

2. Background of the Invention

As a method for speech encoding at a low bit rate of 4.8 to 9.6 kbps, there is recently proposed a code excited linear prediction (CELP) such as vector sum excited linear prediction (VSELP).

The technical content of VSELP is described in Ira A. Gerson and Jasiuk, VECTOR SUM EXCITED LINEAR PREDICTION (VSELP): SPEECH CODING AT 8 KBPS, Paper Presented at the Int. Conf. on Acoustics, Speech and Signal processing, April 1990.

Among the voice coding devices for high efficiency speech compression by digital signal processing using the VSELP is a VSELP encoder. The VSELP encoder analyzes parameters, such as the frame power, reflection coefficients and linear prediction coefficients of the speech, pitch frequency, codebook, pitch or the codebook gain, from input speech signals, and encodes the speech using these analytic parameters. The VSELP encoder, which is the speech encoder for high efficiency speech compression by digital signal processing, is applied to portable telephone apparatus.

The portable telephone apparatus is used frequently outdoors, so that the voice sounds occasionally become hard to hear due to the surrounding background noise. The reason is that the minimum audibility values of the hearing party are increased under the masking effect by noise, thereby deteriorating clearness or articulateness of the received voice sound. Thus it becomes necessary for the speaking side and for the hearing side to suppress the noise or raise the voice volume of the speaking party and to increase the volume of the reproduced voice sound, respectively. On the whole, it becomes necessary to achieve an intimate acoustic coupling between the speaking and hearing parties on one hand and the telephone set on the other hand. For this reason, the portable telephone apparatus is provided with a switch for manually changing over the received sound volume responsive to the surrounding environment.

Meanwhile, it is laborious to change over the received voice sound volume by a manual operation while the portable telephone apparatus is in use. It would be convenient if the received voice sound volume could be changed over automatically.

Should the received voice sound volume be changed over automatically, it becomes crucial whether or not the surrounding noise level can be detected correctly. There are a wide variety of noise sources mixed via a microphone for input voice sounds, but it has been considerably difficult to separate these noise sources, referred to herein as the background noise, from the voice sound.

It has hitherto been proposed to make a distinction between the background noise domain and the speech domain based upon the combination of detection of fundamental period or pitch of the signals, zero-crossing frequency and distribution of frequency components. These techniques are simple but susceptible to mistaken detection. Various algorithms have also been devised for improving the detection frequency, but necessitate a large quantity of processing operations. For example, one of such proposed methods, consisting in inverse filtering input signals using linear prediction coefficients (FUME) averaged over a prolonged time period and monitoring the residue level, involves a large quantity of signal processing operations.

SUMMARY OF THE INVENTION

It is therefore an object of the present invention to provide a speech signal transmitting and receiving apparatus which resolves the above-mentioned problems.

According to the present invention, there is provided a speech signal transmitting and receiving apparatus, such as a portable telephone set, including a speech signal transmitting encoding circuit, a noise domain detection unit, a noise level detection unit and a controller. The speech signal transmitting encoding circuit compresses input speech signals by digital signal processing at a high efficiency. The noise domain detection unit detects the noise domain using an analytic pattern produced by the speech signal transmitting encoding circuit. The noise level detection unit detects the noise level of the noise domain detected by the noise domain detection unit. The controller controls the received sound volume responsive to the noise level detected by the noise level detection unit.

According to the present invention, there is also provided a speech signal transmitting receiving apparatus having a transmitter and a receiver, noise level detection means and a controller. The noise level detection means detect a voice sound signal level entering a transmitting microphone as a noise level when there is no speech input at the transmitter. The controller controls the received sound volume responsive to the noise level detected by said noise level detection means. According to the present invention, the noise domain detection unit detects the noise domain using an analytic parameter produced by the speech signal transmitting encoding circuit, so that the noise domain may be detected with high precision and high reliability despite the smaller processing quantity. The noise level detection unit detects the noise level based upon the detection of the noise domain by the noise domain detection unit, and the controller controls the sound volume of the reproduced speech, so that the received speech may be provided which is high in speech clarity.

In addition, according to the present invention, the noise level detection unit detects the noise level entering the transmitting microphone in the absence of the speech input and the controller controls the received sound volume based upon the detected noise level, so that the received speech may be provided which is high in speech clarity and which is not affected by the background noise.

DESCRIPTION OF THE INVENTION

Figure 1:
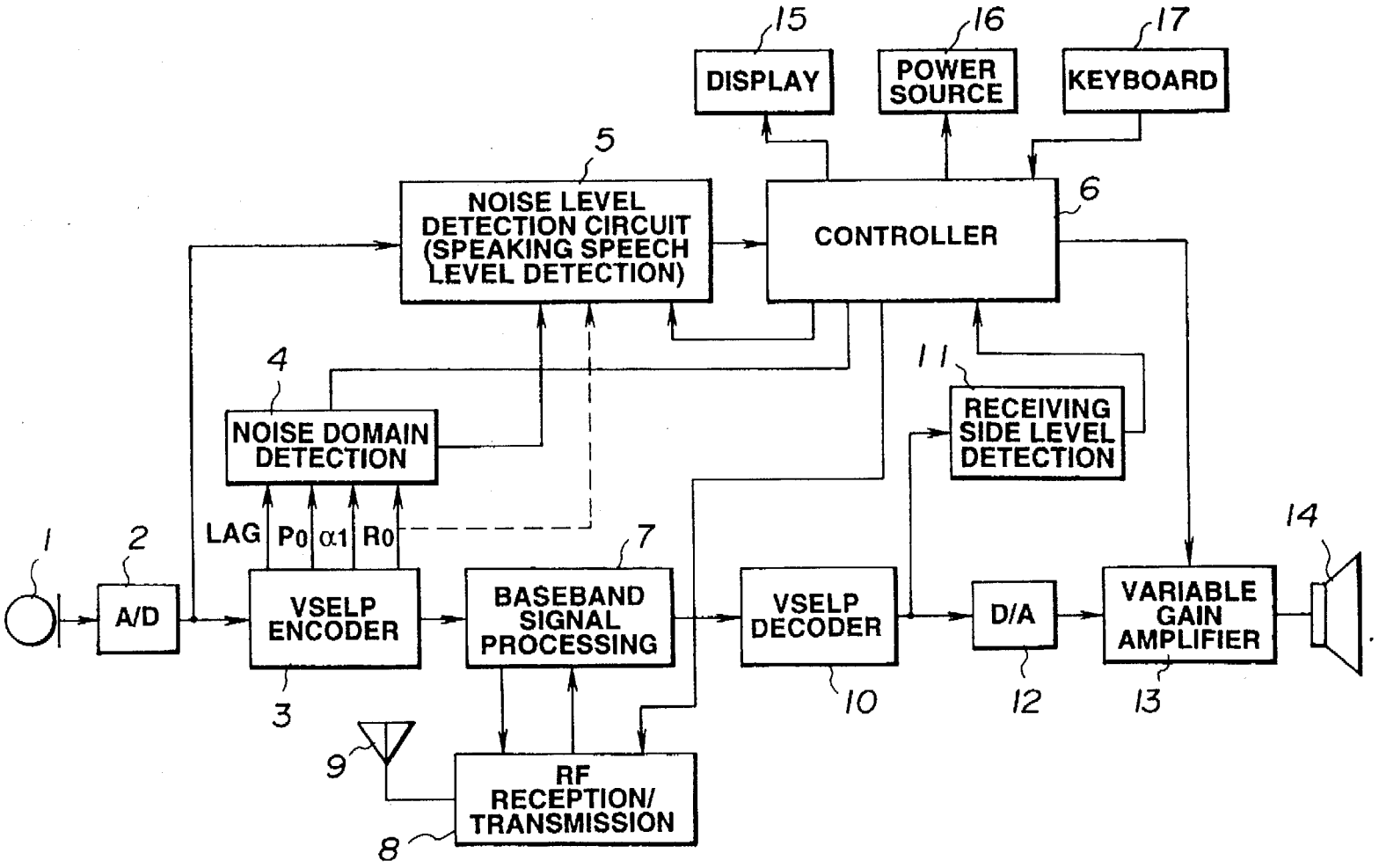
FIG. 1 is a block circuit diagram for illustrating a circuit arrangement of a speech transmitting and receiving apparatus according to the present invention.

Referring to the drawings, preferred embodiments of the speech signal transmitting receiving apparatus according to the present invention are explained in detail.

FIG. 1 shows, in a schematic block circuit diagram, a portable telephone apparatus according to the present invention.

The portable telephone apparatus includes vector sum excited linear prediction (VSELP) encoder 3, a background noise domain detection circuit 4, a noise level detection circuit 5 and a controller 6, as shown in FIG. 1. The noise domain detection circuit 4 detects the background noise domain using parameters for analysis obtained by the VSELP encoder 3, and the noise level detection circuit 5 detects the noise level of the noise domain as detected by the noise domain detection circuit 4. The controller 6 is constituted by a micro-computer and controls the received sound volume responsive to the noise level as detected by the noise level detection circuit 5.

The speech encoding method by the VSELP encoder 3 implements high quality voice transmission at a low bit rate by a codebook search by synthesis analysis. The voice encoding device implementing the speech encoding method employing VSELP (vocoder) encodes the speech by exciting the pitch characterizing input speech signals by selecting the code vectors stored in the codebook. The parameters employed for encoding include the frame power, reflection coefficients, linear prediction coefficients, codebook, pitch and the codebook gain.

Among these parameters for analysis, a frame power $R_0$, a pitch gain $P_0$, indicating the intensity of pitch components, first-order linear prediction encoding coefficients $\alpha_1$ and a lag concerning the pitch frequency LAG are utilized in the present embodiment for detecting the background noise. The frame power $R_0$ is utilized inasmuch as the speech level becomes equal to the noise level on extremely rare occasions, while the pitch gain $P_0$ is utilized inasmuch as the background noise, if substantially random, is thought to be substantially free of any pitch.

The first-order linear prediction encoding coefficient $\alpha_1$ is utilized because the relative magnitude of the coefficient $\alpha_1$ is a measure of which of the high frequency range component or the low frequency range component is predominant. The background noise is usually concentrated in the high frequency range such that the background noise may be detected from the first-order linear prediction encoding coefficient $\alpha_1$. The first-order linear prediction encoding coefficient $\alpha_1$ represents the sum of terms $Z^{-1}$ when a direct high-order FIR filter is divided into cascaded second-order FIR filters. Consequently, if the zero point is in a range of $0<\Theta<\pi/2$, the first-order linear prediction encoding coefficient $\alpha_1$ becomes larger. Consequently, if the value of $\alpha_1$ is larger or lesser than a pre-set threshold, the signal may be said to be a signal in which the energy is concentrated in the low frequency range and a signal in which the energy is concentrated in the high frequency range, respectively.

Turning to the relation between $\Theta$ and the frequency, the frequency in a range of 0 to f/2, where f stands for the sampling frequency, is equivalent to a range of 0 to $\pi$ in a digital system, such as a digital filter. If, for example, the sampling frequency f is 8 kHz, the range of 0 to 4 kHz is equivalent to a range of 0 to $\pi$. Consequently, the smaller the value of 73 , the lower becomes the range of the frequency components. On the other hand, the smaller the value of $\Theta$, the larger becomes the value of $\alpha_1$, Therefore, by checking the relation between the coefficient $\alpha_1$ and a pre-set threshold value, it can be seen whether it is the low-range component or the high-range component that is predominant.

The noise domain detection circuit 4 receives the parameters for analysis, that is the frame power, reflection coefficients, linear prediction coefficients, codebook, pitch and the codebook gain, from the VSELP encoder 3, for detecting the noise domain. This is effective in avoiding the amount of the processing operations being increased, in view that, in keeping up with the tendency towards a smaller size portable telephone set, limitations are placed on the size of the digital signal processing (DSP) device or on the memory size.

The noise level detection circuit 5 detects the voice sound level, that is the speech level of the speaking party, in the noise domain, as detected by the noise domain detection circuit 4. The detected speech level of the speaking party may also be the value of the frame power $R_0$ of a frame ultimately determined to be a noise domain by a decision employing the analytic parameters by the noise domain detection circuit 4. However, in view of the high possibility of mistaken detection, the frame power $R_0$ is inputted to, for example, a 5-tap minimum-value filter (not shown).

The controller 6 detects the noise domain in the noise domain detection circuit 4 and controls the timing of the noise level detection by the noise level detection circuit 5 as well as the sound volume of the reproduced voice sound responsive to the noise level.

Turning to the arrangement of the present telephone apparatus, input speech signals, converted by a transmitting microphone 1 into electrical signals, are converted by an analog/digital (A/D) converter 2 into digital signals, which are supplied to a VSELP encoder 3. The VSELP encoder 3 performs an analysis, information compression and encoding on the digitized input signals, At this time, the analytic parameters, such as the frame power, reflection coefficients and linear prediction coefficients of the input speech signals, pitch frequency, codebook, pitch and the codebook gain, are utilized.

The data processed by the VSELP encoder 3 with information compression and encoding is supplied to a baseband signal processor 7 where appendage of synchronization signals, framing and appendage of error correction codes are performed. Output data of the baseband signal processor 7 is supplied to an RF transmitting receiving circuit where it is modulated to a frequency necessary for transmission, and transmitted via an antenna 9.

Of the analytic parameters, utilized by the VSELP encoder 3, the frame power $R_0$, pitch gain $P_0$, indicating the magnitude of the pitch component, first-order linear prediction coefficient $\alpha_1$ and the lag of the pitch frequency LAG, are routed to the noise domain detection circuit 4. The noise domain detection circuit 4 detects the noise domain, using the frame power $R_0$, pitch gain $P_0$, indicating the magnitude of the pitch component, first-order linear prediction coefficient $\alpha_1$ and the lag of the pitch frequency LAG. The information concerning the frame ultimately found to be the noise domain, that is the flag information, is routed to the noise level detection circuit 5.

The noise level detect-ion circuit 5 is also fed with digital input signals from the A/D converter 2, and detects the noise level signal level depending on the flag information. The signal level in this case may also be the frame power $R_0$, as mentioned previously.

The noise level data, as detected by the noise level detection circuit 5, is supplied to the controller 6. The controller is also fed with the information from the reception side level detection circuit 11, as later explained, and controls the volume of the received sound by changing the gain of a variable gain amplifier 13, as later explained, based upon the above information.

The volume of the received sound herein means the sound volume obtained on reproduction of the signal from the called party transmitted to the present portable telephone set. The signal from the called party is received by the antenna 9 and fed to the RF transmitting receiving circuit 8.

The input voice sound signal from the called party, demodulated into the base band by the RF transmitting receiving circuit 8, is fed to the baseband signal processor 7 where it is processed in a pre-set manner. An output of the baseband signal processor 7 is supplied to a VSELP decoder 10 which then decodes the voice sound signal based upon this information. The voice sound signal thus decoded is supplied to a digital/analog (D/A) converter 12 where it is converted into an analog audio signal.

The voice sound signal, decoded by the VSELP decoder 10, is also supplied to the reception side level detection circuit 11. The detection circuit 11 detects the voice sound level on the receiving side and decides whether or not there is currently the voice sound being supplied from the called party. The detection information from the reception side level detection circuit 11 is supplied to the controller 6.

The analog speech signal from the D/A converter 12 is supplied to a variable gain amplifier 13. The variable gain amplifier 13 has its gain changed by the controller 6, so that the volume of the sound reproduced from a speaker 14, that is the received sound volume, is controlled by the controller 6 responsive to the noise, that is the background noise.

To the controller 6 are connected a display unit 15, a power source circuit 16 and a keyboard 17. The display unit 15 indicates whether or not the portable telephone set is usable, or which of key switches on keyboard 17 has been pressed by the user.

Detection of the noise level by the noise level detection circuit 5 according to the present embodiment is hereinafter explained.

First, the domain in which to detect the noise level needs to be a noise domain as detected by the noise level detection circuit 4. The timing of detecting the noise domain is controlled by the controller 6, as explained previously. Noise domain detection is made in order to assist the noise level detection by the noise level detection circuit 5. That is, a decision is given as to whether a frame under consideration is that of a voiced sound or the noise. If the frame is found to be a noise frame, it becomes possible to detect the noise level. As a matter of course, detection of the noise level may be achieved more accurately if there exists only the noise. Consequently, the sound level entering the transmitting microphone 1 in the absence of the transmitted speech input is detected by the noise level detection circuit 5 which is also sound level detection means on the speaking side.

An initial value of the noise level of −2 dB is first set with respect to a sound volume level as set by the user. If the noise level detected in a manner as later explained is found to be larger than the initial set value, the playback sound volume level on the receiving side is increased.

The noise level can be detected easily if the frame-based input voice sound is the background noise domain. For this reason, the sound received directly after the turning on of the transmitting power source of the transmitting section, during the standby state for a reception signal at the transmitting section, and during the conversation over the telephone with the sound level at the receiving side being higher than a pre-set level, is regarded as being the background noise, and detection is made of the frame noise level during this time.

In operation, the transmitting power source of the transmitting section being turned on is an indication that the user is willing to start using the present portable telephone set. In the present embodiment, the inner circuitry usually makes a self-check. When next the user stretches out the antenna 9, the telephone set enters the stand-by state, after verifying that the interconnection with a base station has been established. Since the input voice sound from the user is received only after the end of the series of operations, there is no likelihood that the user utters a voice sound during this time. Consequently, if the sound level is detected, using the transmitting microphone 1, during this series of operations, the detected sound level is the surrounding noise level, that is the background noise level. Similarly, the background noise level may be detected during or directly after the user has made a transmitting operation (ringing) directly before starting the conversation over the telephone.

The standby state for a reception signal at the transmitting section means the state in which the conversation signal from the called party is being awaited with the power source of the receiving section having been turned on. Such state is not the actual state of conversation, so that it may be assumed that there is no voice sound of conversation between the parties. Thus the background noise level may be detected if the surrounding sound volume level is measured during this standby state using the transmitting microphone 1. It is also possible to make such measurements a number of times at suitable intervals and to average the measured values.

It is seen from the above that the background noise level may be estimated from the sound level directly after the turning on of the transmitting power source of the transmitting section and during the standby state for a reception signal at the transmitting section, and conversation may be started subject to speech processing based upon the estimated noise level. It is however preferred to follow subsequent changes in the background noise level dynamically even during talk over the telephone. For this reason, the background noise level is detected responsive also to the sound level at the receiving section during talk over the telephone.

It is preferred that such detection of the noise level responsive to the sound on the receiving section during talk be carried out after detecting the noise domain by the parameters for analysis employed by the receiving side VSELP encoder 3 as explained previously.

Since noise detection may be made more accurately when the level of the monitored frame power $R_O$ is more than a reference level or when the called party is talking, the reproduced sound volume when the called party is talking may be controlled on the real time basis thereby realizing more agreeable talk quality.

Thus, in the present embodiment, the controller 6 controls the detection timing of the noise domain detection circuit 4 and the noise level detection circuit 5 so that the detection will be made directly after turning on of the transmitting power source of the transmitting section, during the standby state of reception signal at the transmitting section and during talk over the telephone set when the voice sound is interrupted.

Figure 2:
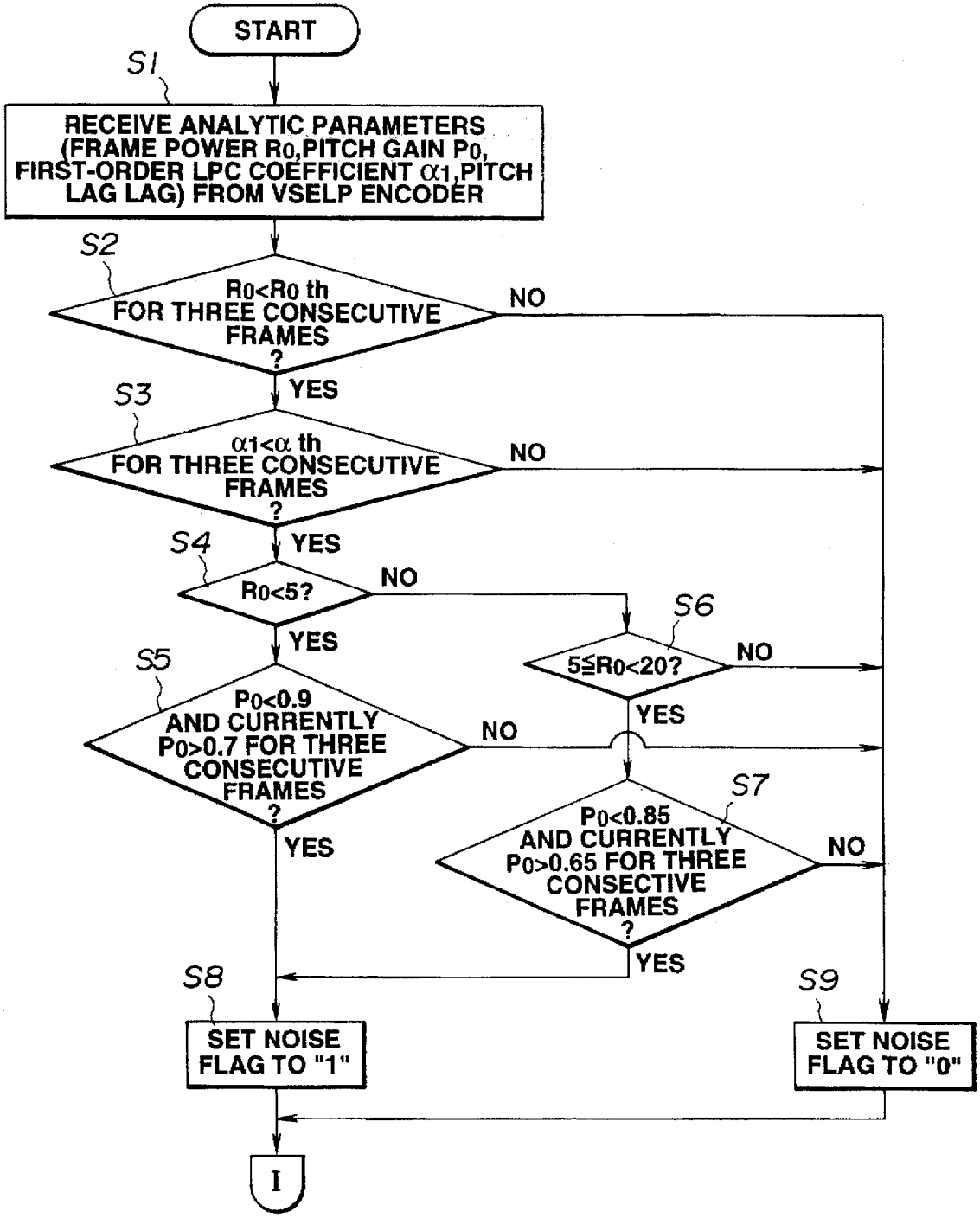
FIGS. 2 and 3 are flow charts for illustrating the operation of a background noise detection circuit of the embodiment shown in FIG. 1.
Figure 3:
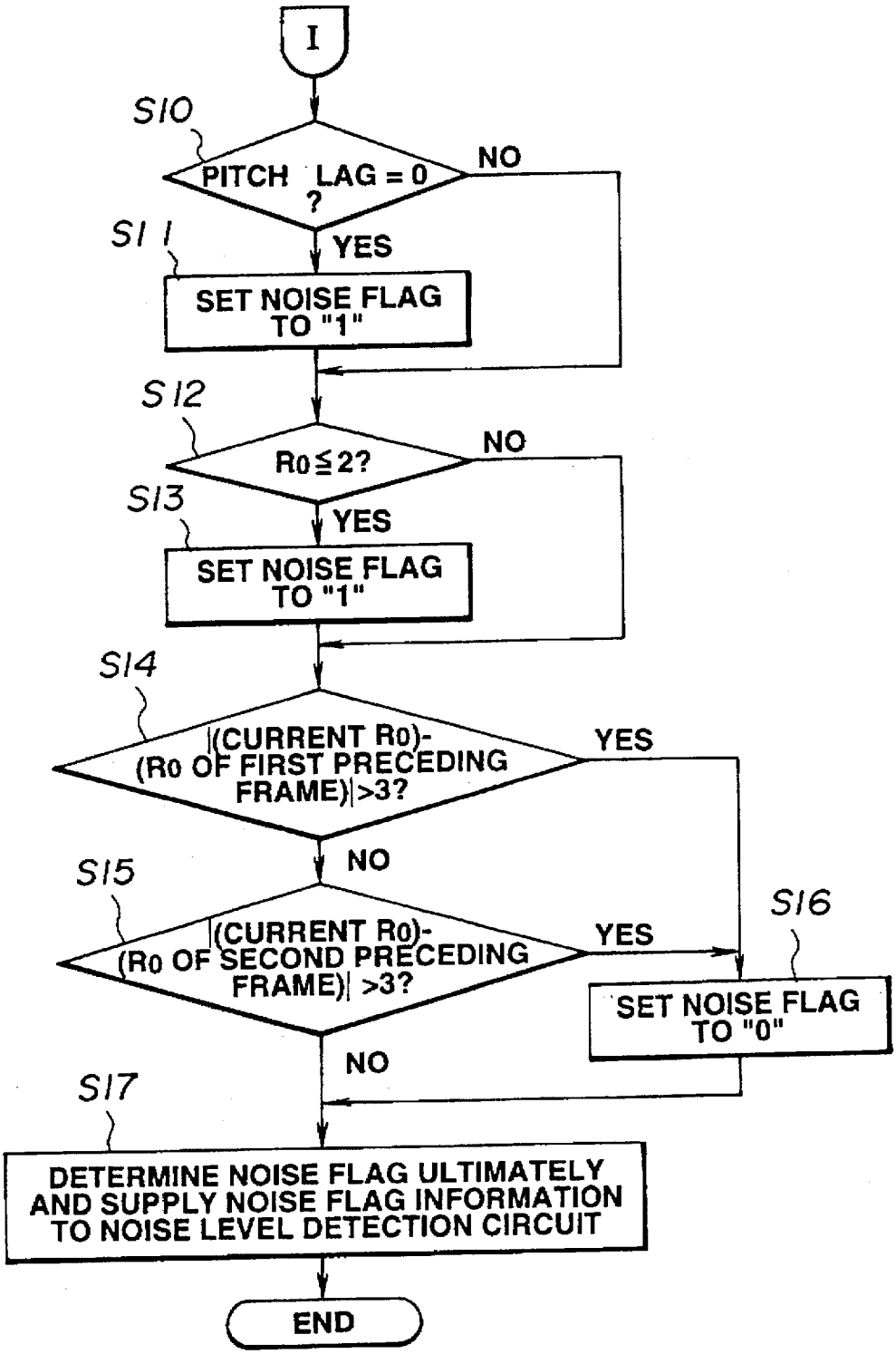

The operation of detecting the noise domain by the noise domain detection circuit 4 is now explained by referring to the flow chart shown in FIGS. 2 and 3.

After the flow chart of FIG. 2 is started, the noise domain detection circuit 4 receives the frame power $R_O$, pitch gain $P_O$, indicating the magnitude of the pitch component, first-order linear prediction coefficient $\alpha_1$ and the lag of the pitch frequency LAG from the VSELP encoder 3.

In the present embodiment, a decision in each of the following steps by the analytic parameters supplied at the step S1 is given in basically three frames because such a decision given in one frame leads to frequent errors. If the ranges of the parameters are checked over three frames, and the noise domain is located, the noise flag is set to "1". Otherwise, the error flag is set to "0". The three frames comprise the current frame and two frames directly preceding the current frame.

Decisions by the analytic parameters through these three consecutive frames are given by the following steps.

At a step S2, it is checked whether or not the frame power $R_O$ of the input voice sound is lesser than a pre-set threshold $R_{Oth}$ for the three consecutive frames. If the result of decision is YES, that is if $R_O$ is smaller than $R_{Oth}$ for three consecutive frames, control proceeds to a step S3. If the result of decision is NO, that is if $R_O$ is larger than $R_{Oth}$ for the three consecutive frames, control proceeds to a step S9. The pre-set threshold $R_{Oth}$ is the threshold for noise, that is a level above which the sound is deemed to be a voice sound instead of the noise. Thus the step S2 is carried out in order to check the signal At a step S3, it is checked whether or not the first-order linear prediction coefficient $\alpha_1$ of the input voice sound is smaller for three consecutive frames than a pre-set threshold $\alpha_{th}$. If the result of decision is YES, that is if $\alpha_1$ is smaller than $\alpha_{th}$ for three consecutive frames, control proceeds to a step S4. Conversely, if the result of decision is NO, that is if $\alpha_1$ is larger than $\alpha_{th}$ for three consecutive frames, control proceeds to a step S9. The pre-set threshold $\alpha_{the}$ has a value which is scarcely manifested at the time of noise analysis. Thus the step S3 is carried out in order to check the gradient of the speech spectrum.

At the step S4, it is checked whether or not the value of the frame power $R_O$ of the current input speech frame is smaller than "5". If the result of decision is YES, that is if $R_O$ is smaller than 5, control proceeds to a step S5. Conversely, if the result of decision is NO, that is if $R_O$ is larger than 5, control proceeds to a step S6. The reason the threshold is set to "5" is that the possibility is high that a frame having a frame power $R_O$ larger than "5" may be a voiced sound.

At the step S5, it is checked whether or not the pitch gain $P_O$ of the input speech signal is smaller than 0.9 for three consecutive frames and the current pitch gain $P_O$ is larger than 0.7. If the result is YES, that is if it is found that the pitch gain $P_O$ is smaller than 0.9 for three consecutive frames and the current pitch gain $P_O$ is larger than 0.7, control proceeds to a step S8. Conversely, if the result of decision is NO, that if it is found that the pitch gain $P_O$ is not lesser than 0.9 for three consecutive frames and the current pitch gain $P_O$ is not larger than 0.7, control proceeds to a step S9. The steps S3 to S5 check the intensity of pitch components.

At the step S6, it is checked, responsive to the negative result of decision at the step S4, that is the result that $R_O$ is 5 or larger, whether or not the frame power $R_O$ is not less than 5 and less than 20. If the result is YES, that is if $R_O$ is not less than 5 and less than 20, control proceeds to a step S7. If the result is NO, that is if $R_O$ is not in the above range, control proceeds to the step S9.

At the step S7, it is checked whether or not the pitch gain $P_O$ of the input speech signals is smaller than 0.85 for three consecutive frames and the current pitch gain $P_O$ is larger than 0.65. If the result is YES, that is if the pitch gain $P_O$ of the input speech signals is smaller than 0.85 for three consecutive frames and the current pitch gain $P_O$ is larger than 0.65, control proceeds to a step S8. Conversely, if the result is NO, that is if the pitch gain $P_O$ of the input speech signals is not less than 0.85 for three consecutive frames and the current pitch gain $P_O$ is not larger than 0.65, control proceeds to the step S9.

At the step S8, responsive to the result of the decision of YES at the step S5 OF S7, the noise flag is set to "1". With the noise flag set to "1", the frame is set as being the noise.

If the decisions given at the steps S2, S3, S5, S6 and S7 are NO, the noise flag is set at the step S9 to "0", and the frame under consideration is set as being the voice sound.

The steps S10 et seq. are shown in the flow chart of FIG. 3.

At a step S10, a decision is given as to whether or not the pitch lag LAG of the input speech signal is 0. If the result of decision is YES, that is if LAG is 0, the frame is set as being the noise because there is but little possibility of the input signal being the voice sound for the pitch frequency LAG equal to 0. That is, control proceeds to a step S11 and sets a noise flag to "1". If the result is NO, that is if LAG is not 0, control proceeds to a step S12.

At the step S12, it is checked whether or not the frame power $R_O$ is 2 or less. If the result is YES, that is if $R_O$ is 2 or less, control proceeds to a step S13. If the result is NO, that is if $R_O$ is larger than 2, control proceeds to a step S14. At the step S13, it is checked whether the frame power $R_O$ is significantly small. If the result is YES, the noise flag is set to "1" during the next step S13, and the frame is set as being a noise.

At the step S13, similarly to the step S11, the noise flag is set to "1", in order to set the frame as being the noise.

At the step S14, the frame power $R_0$ of a frame directly previous to the our rent frame is subtracted from the frame power $R_0$ of the current frame, and it is checked whether or not the absolute value of the difference exceeds 3. The reason is that, if there is an acute change in the frame power $R_0$ between the current frame and the temporally previous frame, the current frame is set as being the voice sound frame. That is, if the result at the step S14 is YES, that is if there is an acute change in the frame power $R_0$ between the current frame and the temporally previous frame, control proceeds to a step S16, in order to set the noise flag to "0", and the current frame is set as being the voice sound frame. If the result is NO, that is if a decision is that there is no acute change in the frame power $R_0$ between the current frame and the temporally previous frame, control proceeds to a step S15.

At the step S15, the frame power $R_0$ of a frame previous to the frame directly previous to the current frame is subtracted from the frame power $R_0$ of the current frame, and it is checked whether or not the absolute value of the difference exceeds 3. The reason is that, if there is an acute change in the frame power $R_0$ between the current frame and the frame previous to the directly previous frame, the current frame is set as being the voice sound frame. That is, if the result at the step S15 is YES, that is if there is an acute change in the frame power $R_0$ between the current frame and the frame previous to the frame directly previous to the current frame, control proceeds to a step S16, in order to set the noise flag to "0", and the current frame is set as being the voice sound frame. If the result is NO, that is if a decision is that there is no acute change in the frame power $R_0$ between the current frame and frame previous to the frame previous to the current frame, control proceeds to a step S17.

At the step S17, the noise flag is ultimately set to "0" or "1", and the corresponding information is supplied to the noise level detection circuit 5.

The noise level detection circuit 5 detects the voice sound level of the noise domain depending on the flag information obtained by the operation at the noise domain detection circuit 4 in accordance with the flow chart shown in FIGS. 2 and 3.

It may however occur that voice sound domain and the noise domain cannot be distinguished from each other by noise domain detection by the noise domain detection circuit 4 or the voice sound is erroneously detected as being the noise. Most of the mistaken detection occurs at the consonant portion of the speech. If the background noise is present to substantially the same level as the consonant portion, there is no change in the reported noise level despite the mistaken detection, so that no particular problem arises. However, if there is substantially no noise, above all, the level difference on the order of 20 to 30 dB is produced, so that a serious problem arises. In a modified embodiment of the present invention, the voice sound mistaken as the noise is not directly used but is smoothed in order to reduce ill effects of mistaken detection.

Figure 4:
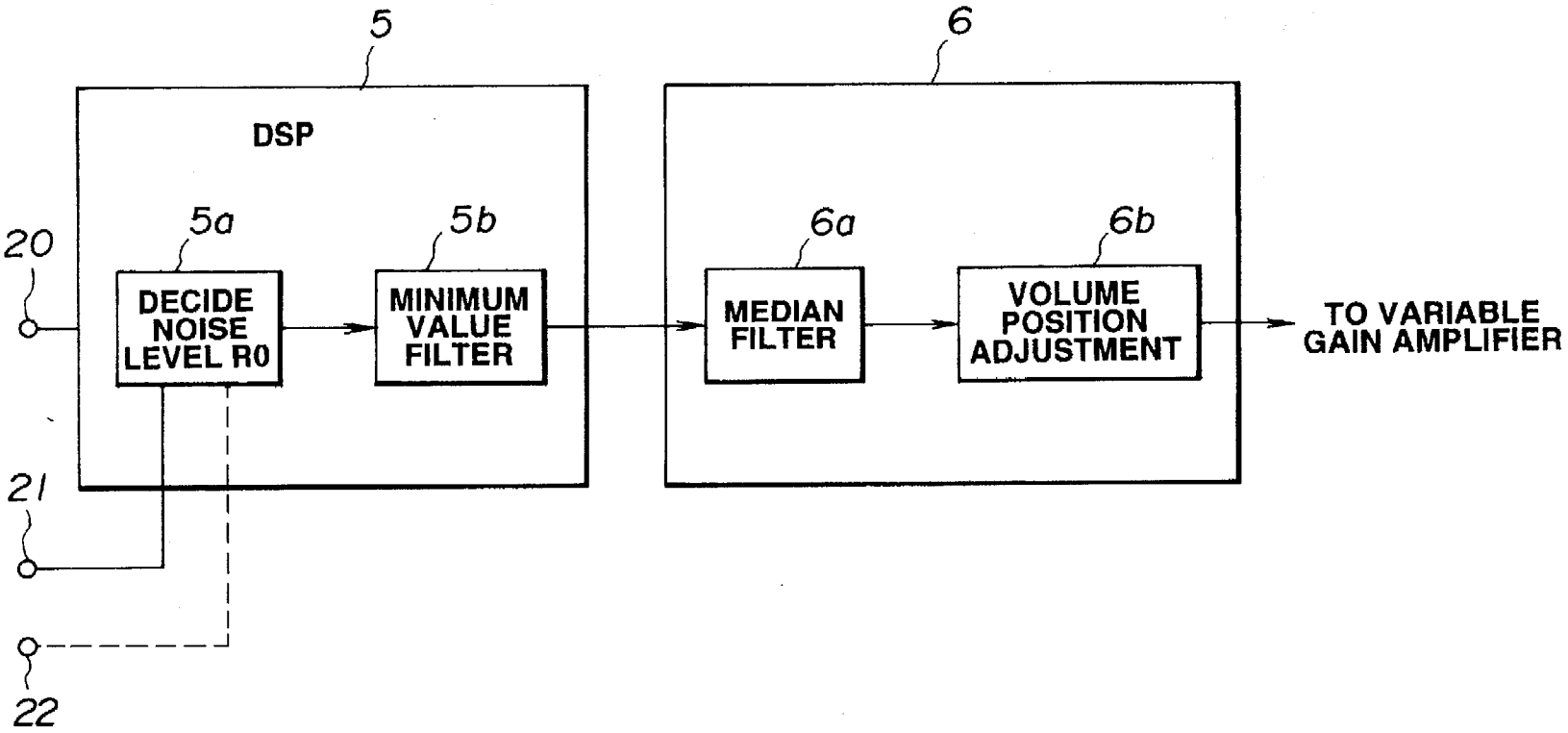
FIG. 4 is a block circuit diagram for illustrating means for preventing errors from affecting the background noise level.

Referring to FIG. 4, detection of the noise level in which the ill effect of mistaken detection is reduced by smoothing or the like means is now explained.

Referring to FIG. 4, digital input signals from an the A/D converter 2 is supplied to an input terminal 20. The flag information from the noise domain detection circuit 4 is supplied via an input terminal 21 to a noise level decision section 5*a* of a noise level detection circuit 5 constituted by a digital signal processor (DSP) 5. The noise level decision section 5*a* is also fed with the frame power $R_0$ from the input terminal 22. That is, the noise level decision section 5*a* determines the noise level of the input voice sound signal based upon the frame power $R_0$ or the flag information from the noise domain detection circuit 4. Specifically, the value of the frame power $R_0$ when the noise flag is ultimately set to "1" at the step S17 of the flow chart shown in FIG. 3 is deemed to be the background noise level.

There is the possibility of mistaken detection at this time, so that the value of $R_0$ is inputted to, for example, a 5-tap minimum value filter 5*b*. The value of $R_0$ is inputted only when the frame is deemed to be a noise. An output of the minimum value filter 5*b* is inputted to a control CPU, such as the controller 6, at a suitable period, such as at an interval of 100 msec. If the output of the minimum value filter 5*b* is not updated, previous values are used repeatedly. The minimum value filter 5*b* outputs a minimum value instead of a center value in a tap as in the case of a median filter as later explained. With the same number of taps, detection errors for up to four consecutive frames can be coped with. For a larger number of detection errors, the ill effects thereof may be reduced by reporting the minimum values as the reporting level.

The signal level $R_0$ is further inputted to a 5-tap median filter 6*a* in the controller 6 for further improving the reliability of the input signal level $R_0$. Filtering is so made that the values in the taps are rearranged in the sequence of increasing values and a mid value thereof is outputted. With the 5-tap median filter, no error is made in the reporting level even if a detection error is produced up to two continuous frames.

An output signal of the median filter 6*a* is supplied to a volume position adjustment unit 6*b*. The volume position adjustment unit 6*b* varies the gain of the variable gain amplifier 13 based upon an output signal of the median filter 6*a*. The controller 6 controls the received voice sound volume as the reproduced voice sound volume in this manner. Specifically, the sound volume increase and decrease is controlled about the volume position as set by the user as the base or mid point of sound volume adjustment. It is also possible to store the noise level directly before the volume adjustment by the user and to increase or decrease the output sound volume based upon the difference between the noise level and the current background noise level.

The filter used may be a smoothing filter, such as a first-order low-pass filter, smoothing the detected background noise level. Depending on the filtering degree of the low-pass filter, follow-up is retarded even if acute level changes are produced due to detection errors,so that the level difference may be reduced.

In this manner, the effects of detection errors may be reduced even if the noise level is detected erroneously.

The method of controlling the volume of the received sound by the detected noise level is now explained.

When controlling the received sound volume, the initially set sound volume is usually changed depending on the background noise, as described above. If the user changes the sound volume manually, the received sound volume is controlled based upon the background noise level.

Figure 5:
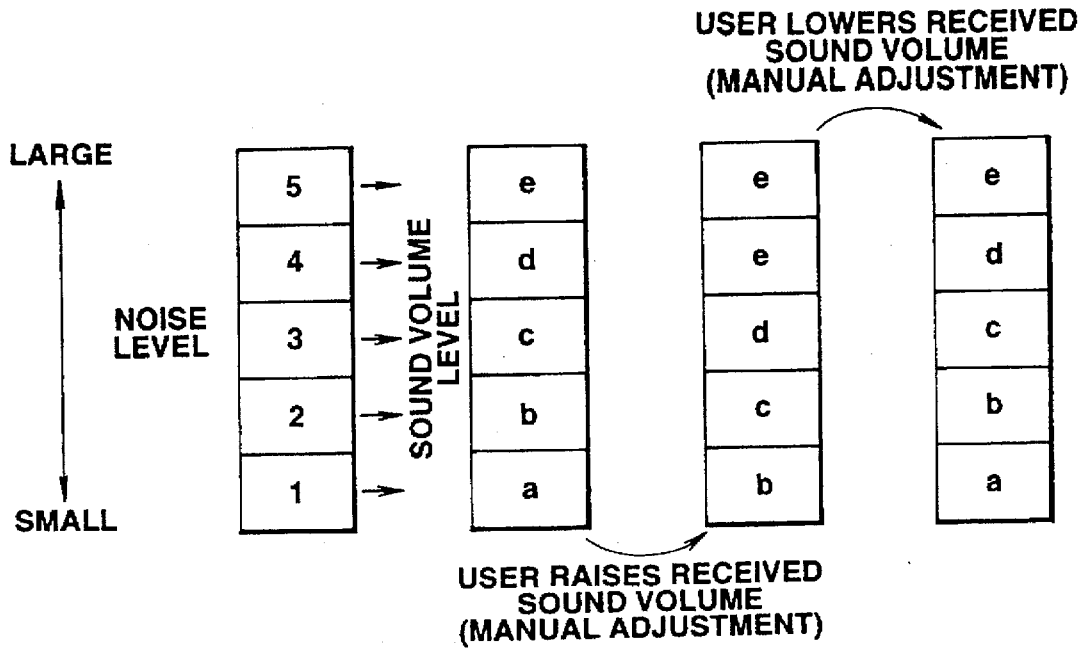
FIG. 5 is shows a specified example of received voice sound volume control by the noise level detected in accordance with the embodiment of FIG. 1.

Specifically, the received sound volume levels a, b, c, d and e conforming to five stages 1 to 5 of the noise level are afforded as initial values, as shown for example in FIG. 5, and the received sound volume is controlled based upon these levels. The levels 1 to 5 are changed in this sequence from a smaller value to a larger value.

If, for example, the user turns a manually adjustable sound volume knob in the sound volume increasing direction, the sound volume level is increased. If, for example, the detected noise level is 3, the received sound volume level is c before the user turns the sound volume knob in the sound volume increasing direction. After the user turns the sound volume knob in the sound volume increasing direction, the received sound volume level becomes equal to d.

If, for example, the user turns a manually adjustable sound volume knob in the sound volume decreasing direction, the sound volume level is decreased. If, for example, the detected noise level is 3, the received sound volume level is d before the user turns the sound volume knob in the sound volume decreasing direction. After the user turns the sound volume knob in the sound volume decreasing direction, the received sound volume level becomes equal to c.

In short, if the user turns the manually adjustable sound volume adjustment knob in the sound volume increasing or decreasing direction, he or she learns the relation of association (mapping) between the noise level and the received sound volume directly before such adjustment of the sound volume adjustment knob. At the time point when the user varies the sound volume adjustment knob, the user varies the relation of association (mapping) between the noise level and the sound volume for dynamically changing the reference value of the received sound volume. In this manner, the received sound volume may be controlled depending upon the noise level based upon the sound volume as intended by the speaking party, that is based upon the sound volume manually adjusted on the sound volume knob by the speaking party.

The algorithm of received sound volume control for the assumed case in which the sound volume on the receiving side can be internally changed by steps of 2 dB is hereinafter explained.

It is assumed that the possible number of steps of sound volume adjustment conforming to the noise level is five and the volume value associated with these steps is 6 dB. The variables storing the volume values as set for the steps are iv1[0] to 1v1[4] and its range is 0~12. That is, the variable value 1 is assumed to correspond to 2 dB.

The initial values of the variables, for example, 1v1[0]=0, 1v1[1]=3, 1v1[2]=6, 1v1[3]=9, 1v1[4]=12, are stored in a non-volatile RAM. These values of the variables correspond to +0 dB, +6 dB, +12 dB, +18 dB and +24 dB, respectively, in terms of actual volume levels. It is assumed that $LV_{now}$ and $LV_{after}$ are the current volume value and the volume to be changed subsequent to noise level readout, respectively. It is also assumed that the noise levels associated with 1v1[0], 1v1[1], 1v1[2], 1v1[3] and 1v1[4] are 0~5, 6~8, 9~15, 16~45 and 46~. These noise levels correspond to 1/16th of the noise level as read by the noise level detection circuit 5, and are changed depending on the gain of the microphone 1.

Figure 6:
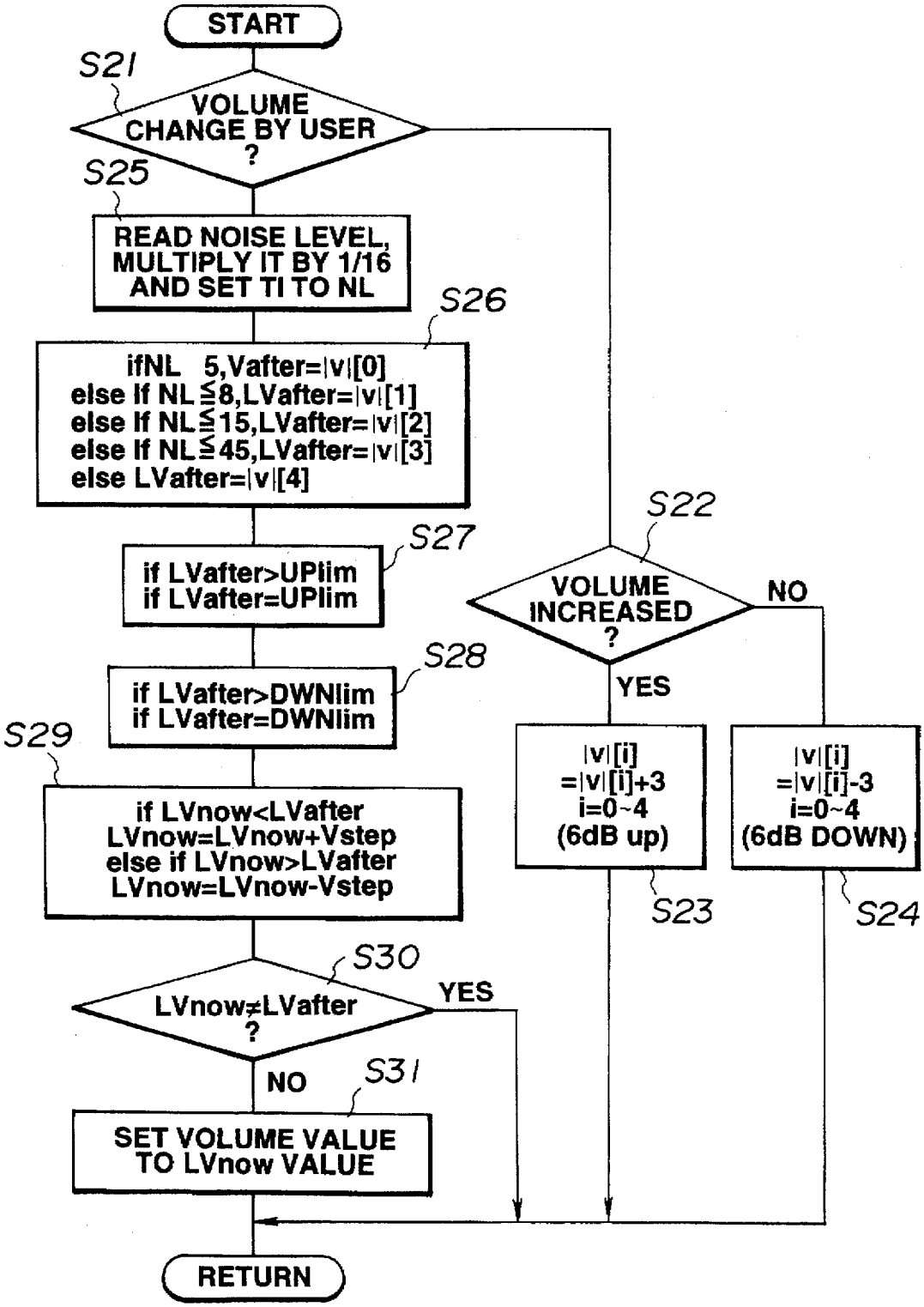
FIG. 6 is a flow chart for illustrating the flow of controlling the received voice sound volume.

FIG. 6 shows, in a flow chart, the algorithm of controlling the received sound volume. The received sound volume control operation shown in FIG. 6 is executed responsive to interrupt at an interval of, for example, 100 milliseconds.

At a first step S21, it is checked whether or not the volume change by the user has been made. If the result is YES, that is if the volume change has been made, control proceeds to a step S22 in order to check if it is produced by the volume increasing operation. If the result is YES, that is if the volume change has been produced by the volume increasing operation, control proceeds to a step S23 in order to set so that 1v1[i]=1v1[i]+3, that is to increase the sound volume by 6 dB, for i=0~4. Control then reverts from the interrupt. If the result of decision at the step S22 is NO, that is if the volume change has been produced by the sound volume decreasing operation, control proceeds to a step S24 in order to set so that 1v1[i]=1v1[i]−3, that is to decrease the sound volume by 6 dB, for i=0~4. Control then reverts from the interrupt.

If the result of decision at the step S21 is NO, that is if it is determined that no volume change has been made by the user, control proceeds to a step S25. The controller 6 reads the noise level detected by the noise level detection circuit 5 and multiplies the detected noise level by 1/16 to produce a noise level NL. Control then proceeds to a step S26.

At the step S26, if the noise level NL is 5 or less (NL≦5), the volume to be changed $LV_{after}$ is set to 1v1[0] ($LV_{after}$=1v1[0]). If otherwise and NL≦8, ($LV_{after}$=1v1[1]) is set. If otherwise and NL≦15, ($LV_{after}$1v1[2]) is set. If otherwise and NL≦45, ($LV_{after}$=1v1[3]) is set. If otherwise, ($LV_{after}$=1v1[4]) is set. It is noted that comparative values with the noise level NL are fluctuated with the gain of the transmitting microphone.

At the next step S27, if $LV_{after}$ is larger than an upper limit value $UP_{lim}$, such as the $UP_{lim}$=12 ($LV_{after}>UP_{lim}$), $LV_{after}$ is limited to be equal to $UP_{lim}$ ($LV_{after}=UP_{lim}$). If, at the next step S28, $LV_{after}$ is smaller than the lower limit value $DWN_{lim}$, such as $DWN_{lim}$=0 ($LV_{after}<DWN_{lim}$), $LV_{after}$ is limited to be equal to $DWN_{lim}$ ($LV_{after}=DWN_{lim}$).

At the next step S29, if the current volume value $LV_{now}$ is smaller than the volume value to be changed $LV_{after}$ ($LV_{now}<LV_{after}$), $LV_{now}$ is increased by a unit step of volume change $V_{step}$ ($LV_{now}=LV_{now}+V_{step}$), whereas, if the current volume value $LV_{now}$ is larger than the volume value to be changed $LV_{after}$ ($LV_{now}>LV_{after}$), $LV_{now}$ is decreased by a unit step of volume change $V_{step}$ ($LV_{now}=LV_{now}-V_{step}$). The unit step $V_{step}$ corresponds to 1, that is 2 dB, as explained previously.

At the next step S30, it is checked whether or not $LV_{now}\neq LV_{after}$. If the result is NO, that is if $LV_{now}=LV_{after}$, control reverts from the interrupt. If the result is YES, that is if $LV_{now}\neq LV_{after}$, the volume value is set to $LV_{now}$, after which control reverts from the interrupt.

By such received sound volume control operation, the volume adjustment by the user and the automatic sound volume adjustment consistent with the noise level may be performed effectively.

For verifying the effectiveness of the above-described embodiment, an example of background noise detection by simulation has been carried out, as hereinafter explained.

As the standard for room noise, such a standard represented by Hoth spectrum is usually employed. However, this Hoth spectrum can hardly be applied to the portable telephone apparatus which is usually employed outdoors. Therefore, the noise actually recorded outdoors was used for simulation. This noise has been recorded in two stations, referred to herein as stations A and B. Inspection was conducted for the following three cases, that is a case of summing the speech to the noise on a computer as digital waveforms, a case of continuously emitting the noise in an audition room and having a talk over a portable telephone set via a microphone under this state and recording the speech, and a case of the speech free of the noise. As for the noise level, a noise environment on the order of 10 dBspl was assumed as the noise environment.

Specifically, simulation was made by a fixed decimal point method, and investigations were made into the detection frequency, detection errors and detected noise levels.

FIGS. 7 to 10 illustrate the examples of detection of the background noise. Thus, FIGS. 7 to 10 illustrate the results of detection of the speech and the background noise when a talk is made over a portable telephone set while the background noise recorded in the precincts of the stations A and B were emitted continuously as samples.

Figure 7:
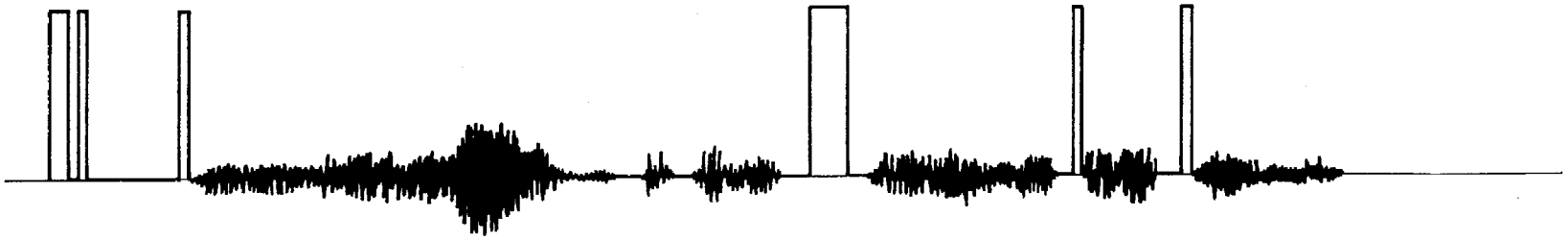
FIG. 7 is a chart showing the results of detection of the background noise as obtained by simulation by a fixed decimal point method and specifically showing the results of detection when utterance is made with the voice sound of a male with a background noise in the precincts of a railway station A.
Figure 8:
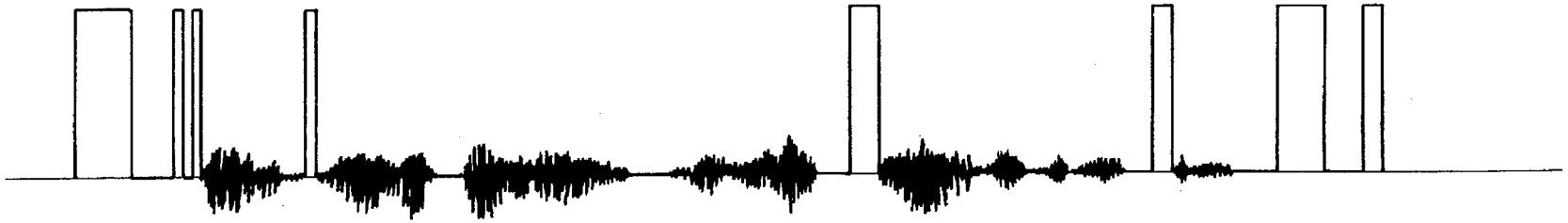
FIG. 8 is a chart showing the results of detection of the background noise as obtained by simulation by a fixed decimal point method and specifically showing the results of detection when utterance is made with the voice sound of a female with a background noise in the precincts of a railway station A.
Figure 9:
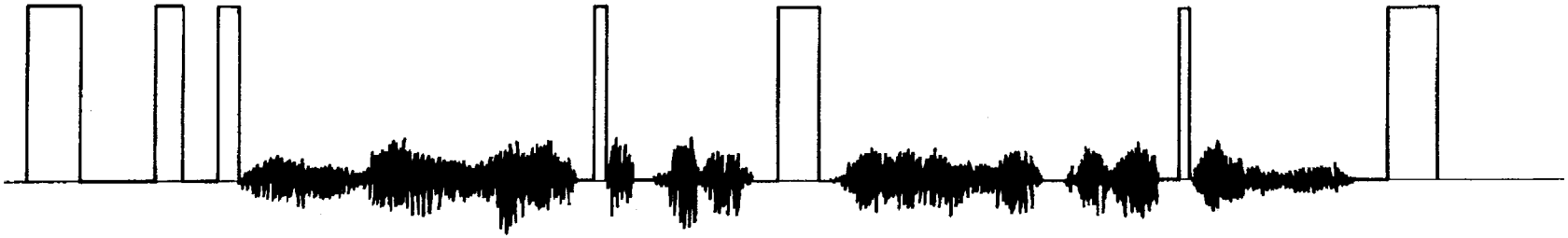
FIG. 9 is a chart showing the results of detection of the background noise as obtained by simulation by a fixed decimal point method and specifically showing the results of detection when utterance is made with the voice sound of a male with a background noise in the precincts of a railway station B.
Figure 10:
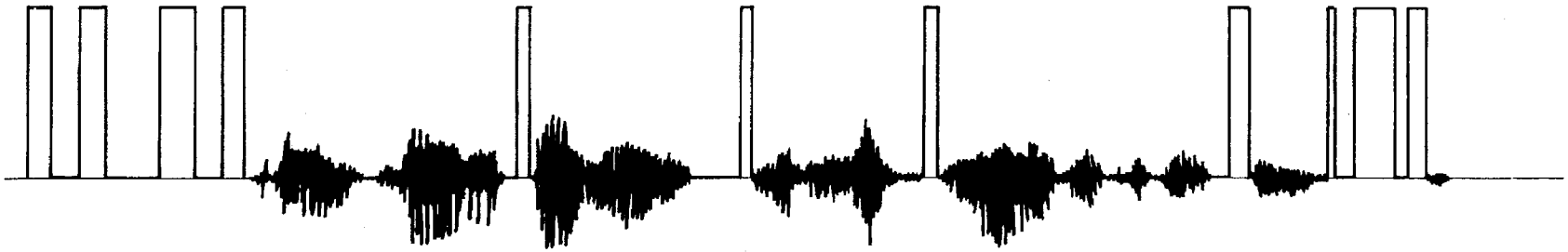
FIG. 10 is a chart showing the results of detection of the background noise as obtained by simulation by a fixed decimal point method and specifically showing the results of detection when utterance is made with the voice sound of a female with a background noise in the precincts of a railway station B.

FIG. 7 shows the results of detection when a male speaker says "Man seeks after abundant nature" as the background recorded within the precincts of the station A is emitted. FIG. 8 shows the results of detection when a female speaker says "Don't work too hard, otherwise you will injure your health" as the background noise recorded within the precincts of the station A is emitted, FIG. 9 shows the results of detection when a male speaker says "Man seeks after abundant nature" as the background noise recorded within the precincts of the station B is emitted. FIG. 10 shows the results of detection when a female speaker says "Don't work too hard, otherwise you will injure your health" as the background noise recorded within the precincts of the station B is emitted.

In the illustrated results of detection, rectangular bars indicate the domains for which detection has been made of what is thought to be the background noise. Although the voice portion and the noise portion cannot be separated completely from each other, detection has been made by units of tens of milliseconds, while mistaken detection of the voice portion as being the noise portion has scarcely been made. As for the detection errors of the background noise in the consonant portion, errors in the reporting level could be avoided by employing the above-mentioned smoothing means. Above all, errors in level reporting due to mistaken detection could be avoided by the minimum value filtering technique.

The above-described simulation for noise detection may be performed by a floating decimal point method on a workstation, instead of by the fixed decimal point method, to produce substantially the same results.

The present invention is not limited to the above-described embodiments. For example, only one analytic parameter may be used for detecting the noise domain, while detection may be made only for one frame, instead of plural consecutive frames, although the resolution in these cases is correspondingly lowered. Processing flow for noise domain detection is also not limited to that shown in the above flow charts.

What is claimed is:

1. A speech signal transmitting and receiving apparatus comprising:

a speech signal encoder for compressing input speech signals by digital signal processing for high quality voice transmission at a low bit rate and for producing patterns of analytic parameters from the input speech signal;

a transmitting and receiving circuit for transmitting the compressed speech signals output by said speech signal encoder and for receiving compressed speech signals transmitted from another transmitter and reproducing a corresponding received sound;

noise domain detection means supplied with patterns of analytic parameters produced by said speech signal encoder during compression of the input speech signals for determining a noise domain in which only noise exists in the input speech signal;

noise level detecting means for detecting a noise level of the input speech signal in the noise domain; and means for controlling a volume of the corresponding received sound responsive to the noise level detected by said noise domain detection means.

2. The speech signal transmitting and receiving apparatus as claimed in claim 1 wherein said noise domain detection means employs a first-order linear prediction encoding coefficient as one of the analytic parameters for each frame of a plurality of frames and deems a frame to be the noise domain if the first-order linear prediction encoding coefficient is smaller than a pre-set threshold.

3. The speech signal transmitting and receiving apparatus as claimed in claim 2 wherein said noise domain detection means employs a pitch gain indicating the intensity of pitch components as one of the analytic parameters for each frame and deems a frame to be the noise domain if the pitch gain is within a preset range.

4. The speech signal transmitting and receiving apparatus as claimed in claim 3 wherein said noise domain detection means employs a pitch lag as one of the analytic parameters for each frame and deems a frame to be the noise domain if the pitch lag is zero.

5. The speech signal transmitting and receiving apparatus as claimed in claim 4 wherein said noise domain detection means employs a frame power as one of the analytic parameters for each frame and deems a particular frame to be the noise domain if the frame power for the particular frame is smaller than a pre-set threshold.

6. The speech signal transmitting and receiving apparatus as claimed in claim 5 wherein, if an amount of change of the frame power between a current frame and a past frame exceeds a pre-set threshold, said noise domain detection means deems said current frame to be a speech domain, even if said current domain is the noise domain.

7. The speech signal transmitting and receiving apparatus as claimed in claim 6 wherein said noise domain detection means detects the noise domain in view of the value of the analytic parameters over plural consecutive frames.

8. The speech signal transmitting and receiving apparatus as claimed in claim 7 wherein said noise level detection means performs filtering on a noise level output of the noise domain detected by said noise domain detection means.

9. The speech signal transmitting and receiving apparatus as claimed in claim 8 wherein the filtering performed by said noise level detection means on the noise level output is minimum value filtering.

10. The speech signal transmitting and receiving apparatus as claimed in claim 1 wherein said noise domain detection means employs a pitch gain indicating the intensity of pitch components as one of the analytic parameters for each frame of a plurality of frames and deems a frame to be the noise domain if the pitch gain is within a pre-set range.

11. The speech signal transmitting and receiving apparatus as claimed in claim 1 wherein said noise domain detection means employs a pitch lag as one of the analytic parameters for each frame of a plurality of frames and deems a frame to be the noise domain if the pitch lag is zero.

12. The speech signal transmitting and receiving apparatus as claimed in claim 1 wherein said noise domain detection means employs a frame power as one of the analytic parameters for each frame of a plurality of frames and deems a frame to be the noise domain if the frame power for said one frame is smaller than a pre-set threshold.

13. The speech signal transmitting and receiving apparatus as claimed in claim 1 wherein said noise domain detection means employs a frame power as one of the analytic parameters for each frame of a plurality of frames and, if an amount of change of the frame power between a current frame and a past frame exceeds a pre-set threshold, said noise domain detection means deems said current frame to be a speech domain, even if said current domain is the noise domain.

14. The speech signal transmitting and receiving apparatus as claimed in claim 1 wherein said noise domain detection means detects the noise domain in view of the value of the analytic parameters over plural consecutive frames.

15. The speech signal transmitting and receiving apparatus as claimed in claim 1 wherein said noise domain detection means performs filtering on a noise level output of the noise domain detected by said noise domain detection means.

16. The speech signal transmitting and receiving apparatus as claimed in claim 1 wherein the filtering performed by said noise level detection means on the noise level output is minimum value filtering.

17. A speech signal transmitting and receiving apparatus having a transmitter and a receiver, comprising:

noise level detection means for detecting a sound signal level entering a transmitting microphone as a noise level when there is no transmitting speech input at said transmitter; and control means for controlling a volume of sound reproduced from a compressed speech signal received from another transmitter responsive to the noise level detected by said noise level detection means.

18. The speech signal transmitting and receiving apparatus as claimed in claim 17 wherein said noise level detection means detects the sound level entering said transmitting microphone of the transmitter directly after turning on of a power source for talk transmission.

19. The speech signal transmitting and receiving apparatus as claimed in claim 18 wherein said noise level detection means detects the sound level entering said transmitting microphone when the sound level in said receiver exceeds a pre-set value.

20. The speech signal transmitting and receiving apparatus as claimed in claim 17 wherein said noise level detection means detects the sound level entering said transmitting microphone at a pre-set time interval in the standby state of said transmitter for signal reception.

21. The speech signal transmitting and receiving apparatus as claimed in claim 20 wherein said noise level detection means detects the sound level entering said transmitting microphone when the sound level in said receiver exceeds a pre-set value.

22. The speech signal transmitting and receiving apparatus as claimed in claim 17 wherein said noise level detection means detects the sound level entering said transmitting microphone when the sound level in said receiver exceeds a pre-set value.

* * * * *

UNITED STATES PATENT AND TRADEMARK OFFICE

CERTIFICATE OF CORRECTION

PATENT NO. : 5,732,390
DATED : March 24, 1998
INVENTOR(S) : KEIICHI KATAYANAGI ET AL.

It is certified that error appears in the above-indentified patent and that said Letters Patent is hereby corrected as shown below:

Add the following text to the title page:

--[73] Assignee: Sony Corporation
Tokyo, Japan

Signed and Sealed this

FourthDay of August, 1998

Bruce Lehman

*Attest:*

BRUCE LEHMAN

*Attesting Officer*

*Commissioner of Patents and Trademarks*

US005732390C1

(12) EX PARTE REEXAMINATION CERTIFICATE (8802nd)

United States Patent
Katayanagi et al.

(10) Number: US 5,732,390 C1
(45) Certificate Issued: Jan. 17, 2012

(54) SPEECH SIGNAL TRANSMITTING AND RECEIVING APPARATUS WITH NOISE SENSITIVE VOLUME CONTROL

(75) Inventors: Keiichi Katayanagi, Tokyo (JP); Kentaro Odaka, Tokyo (JP); Masayuki Nishiguchi, Tokyo (JP)

(73) Assignees: Mobilemedia Ideas LLC, Chevy Chase, MD (US); Sony Corporation, Tokyo (JP)

Reexamination Request:
No. 90/009,921, Jun. 30, 2011

Reexamination Certificate for:

| | |
|---|---|
| Patent No.: | **5,732,390** |
| Issued: | **Mar. 24, 1998** |
| Appl. No.: | **08/695,522** |
| Filed: | **Aug. 12, 1996** |

Certificate of Correction issued Aug. 4, 1998.

Related U.S. Application Data

(63) Continuation of application No. 08/263,125, filed on Jun. 21, 1994, now abandoned.

(51) Int. Cl.

| | |
|---|---|
| ***G10L 11/02*** | (2006.01) |
| ***G10L 11/00*** | (2006.01) |
| *G10L 21/02* | (2006.01) |
| *G10L 21/00* | (2006.01) |

(52) U.S. Cl. ..... 704/227; 704/222; 704/223; 704/225; 704/226; 704/228; 704/233; 704/E11.003

(58) Field of Classification Search ..... None
See application file for complete search history.

(56) References Cited

To view the complete listing of prior art documents cited during the proceeding for Reexamination Control Number 90/009,921, please refer to the USPTO's public Patent Application Information Retrieval (PAIR) system under the Display References tab.

*Primary Examiner*—Roland Foster

(57) ABSTRACT

A speech signal transmitting receiving apparatus, such as a portable telephone set, includes a speech signal transmitting encoding circuit, a noise domain detection unit, a noise level detection unit and a controller. The speech signal transmitting encoding circuit compresses input speech signals by digital signal processing at a high efficiency. The noise domain detection unit detects the noise domain using an analytic pattern produced by the speech signal transmitting encoding circuit. The noise level detection unit detects the noise level of the noise domain detected by the noise domain detection unit. The controller controls the received sound volume responsive to the noise level detected by the noise level detection unit.

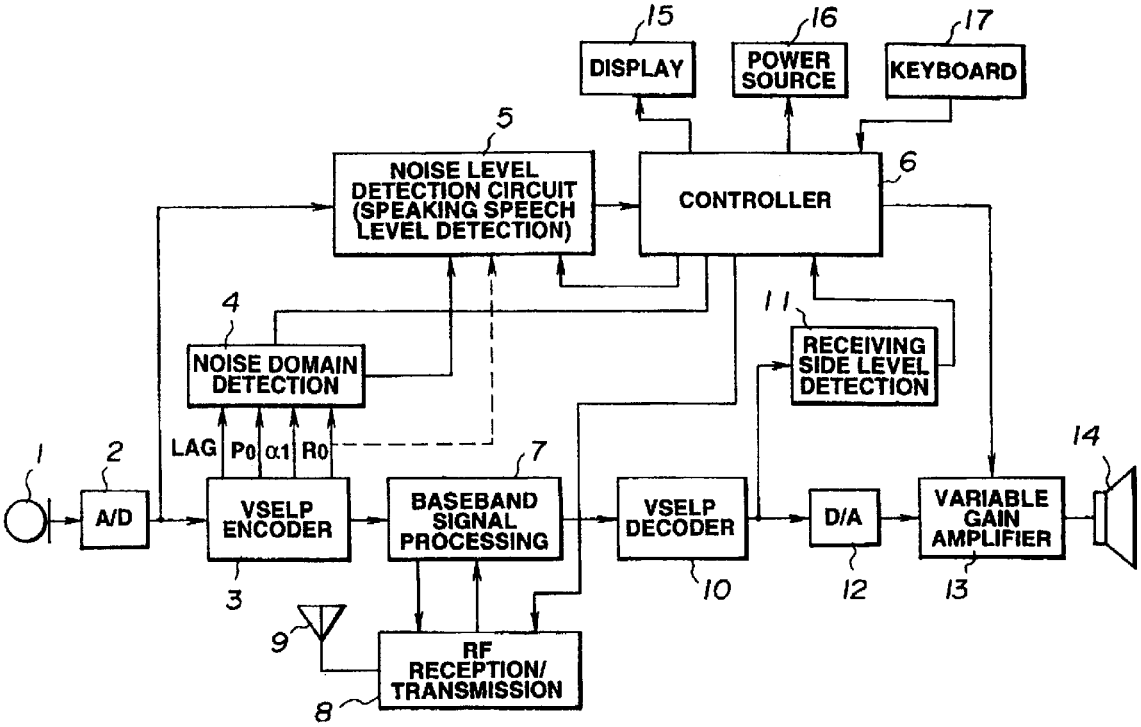

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 17 is confirmed.

New claims 23-30 are added and determined to be patentable.

Claims 1-16 and 18-22 were not reexamined.

*23. The speech signal transmitting and receiving apparatus of claim 17 wherein the control means is also for controlling the volume of sound reproduced from the compressed speech signal received from said another transmitter in response to a user provided volume change operation.*

*24. The speech signal transmitting and receiving apparatus of claim 23 wherein the control means is also for increasing or decreasing a target volume associated with a noise level range by an amount in response to said user provided volume change operation.*

*25. The speech signal transmitting and receiving apparatus of claim 24 wherein the control means is also for increasing the target volume associated with the noise level range if said user provided volume change operation is a volume increasing operation.*

*26. The speech signal transmitting and receiving apparatus of claim 24 wherein the control means is also for decreasing the target volume associated with the noise level range if said user provided volume change operation is a volume increasing operation.*

*27. The speech signal transmitting and receiving apparatus of claim 17 wherein the control means is also for controlling the volume of sound reproduced from the compressed speech signal received from said another transmitter in 6 dB increments.*

*28. The speech signal transmitting and receiving apparatus of claim 17 wherein a noise level is changed depending on a property of the microphone.*

*29. The speech signal transmitting and receiving apparatus of claim 17 wherein the control means is also for controlling the volume of sound reproduced during each of plural predefined intervals.*

*30. The speech signal transmitting and receiving apparatus of claim 17 wherein the control means is also for controlling the volume of sound reproduced from the compressed speech signal received from another transmitter responsive to the detected noise level received during each of plural predefined intervals.*

* * * * *

US005732390C2

(12) EX PARTE REEXAMINATION CERTIFICATE (9642nd)

United States Patent
Katayanagi et al.

(10) Number: US 5,732,390 C2
(45) Certificate Issued: May 10, 2013

(54) SPEECH SIGNAL TRANSMITTING AND RECEIVING APPARATUS WITH NOISE SENSITIVITY VOLUME CONTROL

(75) Inventors: Keiichi Katayanagi, Tokyo (JP); Kentaro Odaka, Tokyo (JP); Masayuki Nishiguchi, Tokyo (JP)

(73) Assignee: Mobilemedia Ideas LLC, Chevy Chase, MD (US)

Reexamination Request:
No. 90/012,442, Aug. 21, 2012

Reexamination Certificate for:

| | |
|---|---|
| Patent No.: | **5,732,390** |
| Issued: | **Mar. 24, 1998** |
| Appl. No.: | **08/695,522** |
| Filed: | **Aug. 12, 1996** |

Reexamination Certificate C1 5,732,390 issued Jan. 17, 2012

Certificate of Correction issued Aug. 4, 1998

Related U.S. Application Data

(63) Continuation of application No. 08/263,125, filed on Jun. 21, 1994, now abandoned.

(30) Foreign Application Priority Data

| | | |
|---|---|---|
| Jun. 29, 1993 | (JP) | 5-182138 |
| Mar. 11, 1994 | (JP) | 6-040729 |

(51) Int. Cl.

| | |
|---|---|
| ***G10L 21/02*** | (2006.01) |
| ***G10L 11/02*** | (2006.01) |
| ***G10L 11/00*** | (2006.01) |
| ***G10L 21/00*** | (2006.01) |

(52) U.S. Cl.
USPC ..... 704/227; 704/222; 704/223; 704/225; 704/228; 704/233; 704/E11.003

(58) Field of Classification Search
None
See application file for complete search history.

(56) References Cited

To view the complete listing of prior art documents cited during the proceeding for Reexamination Control Number 90/012,442, please refer to the USPTO's public Patent Application Information Retrieval (PAIR) system under the Display References tab.

*Primary Examiner* — Salman Ahmed

(57) ABSTRACT

A speech signal transmitting receiving apparatus, such as a portable telephone set, includes a speech signal transmitting encoding circuit, a noise domain detection unit, a noise level detection unit and a controller. The speech signal transmitting encoding circuit compresses input speech signals by digital signal processing at a high efficiency. The noise domain detection unit detects the noise domain using an analytic pattern produced by the speech signal transmitting encoding circuit. The noise level detection unit detects the noise level of the noise domain detected by the noise domain detection unit. The controller controls the received sound volume responsive to the noise level detected by the noise level detection unit.

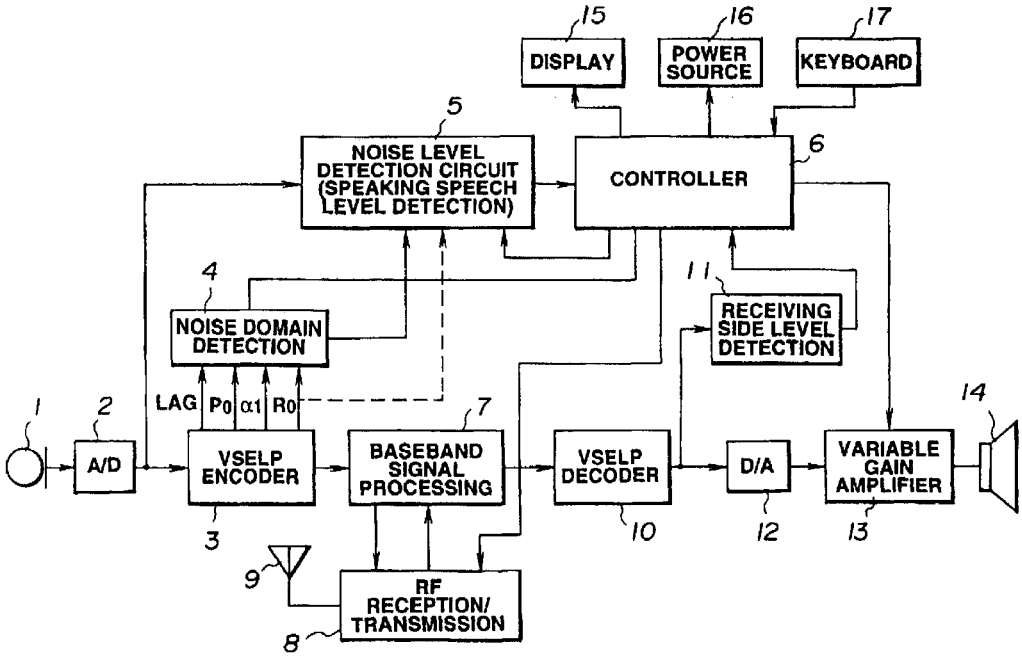

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 17 is confirmed.

New claims 31-38 are added and determined to be patentable.

Claims 1-16 and 18-30 were not reexamined.

*31. The speech signal transmitting and receiving apparatus of claim 17 wherein the speech signal transmitting and receiving apparatus is a portable telephone apparatus.*

*32. The speech signal transmitting and receiving apparatus of claim 17 wherein the noise level detection means determines a noise level based on at least one parameter for analysis obtained from the sound signal entering the microphone.*

*33. The speech signal transmitting and receiving apparatus of claim 17 wherein the noise level is filtered prior to being provided to the control means.*

*34. The speech signal transmitting and receiving apparatus of claim 17 wherein the noise level is processed to retard volume control of the control means.*

*35. A speech signal transmitting and receiving apparatus in a portable telephone having a transmitter and a receiver, comprising:*

*noise level detection means for detecting a sound signal level entering a transmitting microphone, said sound signal level being reported as a noise level when there is no transmitting speech input at said transmitter; and*

*control means for controlling a volume of sound reproduced from a compressed speech signal received from another transmitter responsive to the noise level detected by said noise level detection means.*

*36. The speech signal transmitting and receiving apparatus of claim 35 further comprising:*

*a microphone configured to convert an input speech signal into an electrical signal;*

*an analog/digital converter configured to convert the electrical signal produced by the microphone into a digital signal;*

*an encoder configured to compress the digital signal produced by the analog/digital converter;*

*a baseband signal processor configured to append synchronization signals, framing and error correction codes to the compressed digital signal produced by the encoder; and*

*an RF transmitting circuit configured to modulate a frequency with the signal as appended by the baseband signal processor.*

*37. The speech signal transmitting and receiving apparatus of claim 36 further comprising:*

*a keyboard; and*

*a display unit operable to indicate whether or not the speech signal transmitting and receiving apparatus is usable and which keys on the keyboard have been selected by a user of the speech signal transmitting and receiving apparatus.*

*38. A speech signal transmitting and receiving apparatus having a transmitter and a receiver, comprising:*

*noise level detection means for detecting a sound signal level entering a transmitting microphone, and for reporting said detected sound signal level as a noise level, said noise level detection circuit being configured to detect a sound signal level when there is no transmitting speech input at said transmitter and when there is transmitting speech input at said transmitter; and*

*control means for controlling a volume of sound reproduced from a compressed speech signal received from another transmitter responsive to the noise level detected by said noise level detection means.*

* * * * *